United States Patent [19]

Morten

[11] Patent Number: 5,075,910

[45] Date of Patent: Dec. 31, 1991

[54] INFLATABLE HEADBOARD

[76] Inventor: J. Gregory Morten, 180 St. Albans Fwy., Memphis, Tenn. 38111

[21] Appl. No.: 753,912

[22] Filed: Sep. 3, 1991

[51] Int. Cl.[5] ..... A47C 19/02; A47C 31/10

[52] U.S. Cl. ..... 5/53.1; 5/449; 5/424

[58] Field of Search ..... 5/53.1, 53.2, 53.3, 5/449, 455, 279.1, 454, 453, 432, 433, 424

[56] References Cited

U.S. PATENT DOCUMENTS

| | | | |
|---|---|---|---|
| 1,312,110 | 8/1919 | Duncan et al. . | |
| 1,830,570 | 11/1931 | Smith et al. . | |
| 2,641,779 | 6/1953 | Gill | 5/317 |
| 3,116,569 | 1/1964 | Kramer | 45/138 |
| 3,420,574 | 1/1969 | Smith | 297/456 |
| 3,513,489 | 5/1970 | Miller et al. | 5/98 |
| 3,606,623 | 9/1971 | Aymar | 5/433 |
| 3,845,511 | 11/1974 | Benoit et al. | 5/53 |
| 4,200,942 | 5/1980 | Case | 5/419 |
| 4,815,153 | 3/1989 | Bleser et al. | 5/98 |
| 4,821,349 | 4/1989 | Cohen | 5/53 |

FOREIGN PATENT DOCUMENTS

| | | | |
|---|---|---|---|
| 333738 | 8/1930 | United Kingdom | 5/432 |
| 454284 | 9/1936 | United Kingdom | 5/53.1 |
| 1285552 | 8/1972 | United Kingdom | 5/433 |
| 2095986 | 10/1982 | United Kingdom | 5/53.1 |
| 2107978 | 5/1983 | United Kingdom | 5/53.1 |
| 2130878 | 6/1984 | United Kingdom | 5/53.1 |

*Primary Examiner*—Alexander Grosz
*Attorney, Agent, or Firm*—Walker & McKenzie

[57] ABSTRACT

A headboard including an inflatable body member for being positioned adjacent the head of the bed, and mounting structure for mounting the inflatable body member adjacent the head of the bed.

11 Claims, 2 Drawing Sheets

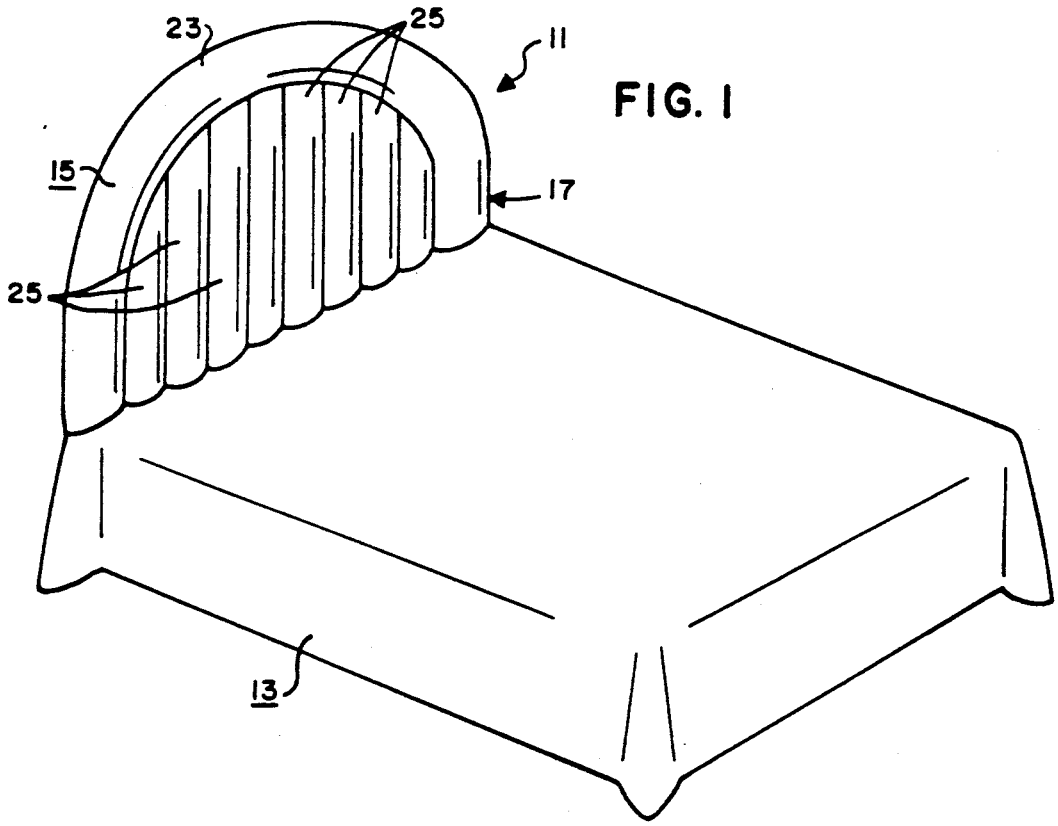
FIG. 1
FIG. 2
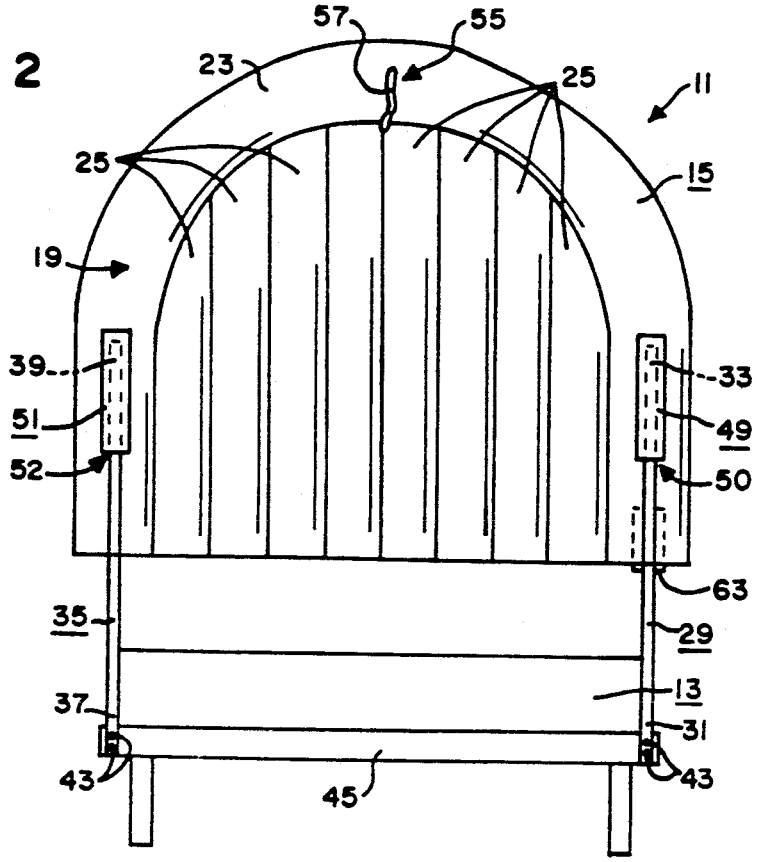

INFLATABLE HEADBOARD

BACKGROUND OF THE INVENTION

1. Field of the Invention

The present invention relates, in general, to headboards for beds and the like, and more specifically to an inflatable headboard.

2. Description of the Related Art

Headboards are typically attached to the frame of a bed at the "head end" thereof. A preliminary patentability search conducted in class 5, subclasses 53.1, 95, 183, 279.1, 419, 449, 454, 461, 462 and 51.1 produced the following patents that relate to headboards in general:

Gill, U.S. Pat. No. 2,641,779, issued June 16, 1953, discloses a decorative cover for a conventional type headboard. More specifically, Gill discloses a cushion that conforms to the contour of the headboard and is fastened thereto with a plurality of tapes or ties, and a cover that is manufactured from quilted or other decorative fabric and completely encloses the headboard and the cushion.

Kramer, U.S. Pat. No. 3,116,569, issued Jan. 7, 1964, discloses a quilted headboard and a method of fabrication thereof.

Benoit et al., U.S. Pat. No. 3,845,511, issued Nov. 5, 1974, discloses a universal headboard construction that is reversible and can be used either at the head of a bed or at the foot of a bed.

Cohen, U.S. Pat. No. 4,821,349, issued Apr. 18, 1989, discloses a headboard that includes a knock-down frame that can be adjusted between twin, full, queen and king sizes, and a fabric slip cover for covering the frame and holding the frame together The fabric slip cover may be cushioned, quilted, or tufted, and may be constructed out of leather.

The above-referenced patentability search also produced the following patents which may be relevant to the present invention:

Duncan et al., U.S. Pat. No. 1,312,110, issued Aug. 5, 1919, discloses a flat, pad-like mattress attachment that can be moved to a vertical position and attached to the headboard or footboard of the bed to protect the feet and head of the occupant of the bed from drafts of cold air.

Smith et al., U.S. Pat. No. 1,830,570, issued Nov. 3, 1931, discloses pneumatic upholstery for being attached to the seat and back of a chair.

Smith, U.S. Pat. No. 3,420,574, issued Jan. 7, 1969 discloses a collapsible chair including an inflatable member. The chair can be collapsed and deflated for shipping and storage, but can be readily inflated and erected when desired.

Miller et al., U.S. Pat. No. 3,513,489, issued May 26, 1970, discloses a bassinette having air-inflatable side and end walls.

Case, U.S. Pat. No. 4,200,942, issued May 6, 1980, discloses a towel having an inflatable pillow incorporated therein for use as a mat for sun bathing or the like.

Bleser et al., U.S. Pat. No. 4,815,153, issued Mar. 28, 1989, discloses an inflatable play pen.

None of the above patents or prior art disclose or suggest the present invention. More specifically, none of the above patents or prior art disclose or suggest a headboard including an inflatable body member for being positioned adjacent the head of a bed, and mounting means for mounting the inflatable body member adjacent the head of the bed.

SUMMARY OF THE INVENTION

The present invention is directed toward providing an improved headboard for the head of a bed. One object of the present invention is to provide a decorative, low cost headboard that can be easily attached to existing bed frames. Another objective of the present invention is to provide a headboard that is more comfortable to lean against, etc., than typical, hard, rigid, wood headboards and the like. Another object of the present invention is to provide a headboard that can be easily and quickly replaced with another headboard of the same general construction but having a different color and/or design to allow the decor of the bedroom to be easily and quickly changed.

The headboard of the present invention includes, in general, an inflatable body member for being positioned adjacent the head of a bed, and mounting means for mounting the inflatable body member adjacent the head of the bed.

BRIEF DESCRIPTION OF THE DRAWINGS

FIG. 1 is a perspective view of a bed with the headboard of the present invention combined therewith.

FIG. 2 is a left end elevational view of FIG. 1 with portions thereof omitted for clarity and showing the back side of the inflatable body member and one embodiment of the mounting means of the headboard of the present invention.

DESCRIPTION OF THE PREFERRED EMBODIMENT

Figure 3:
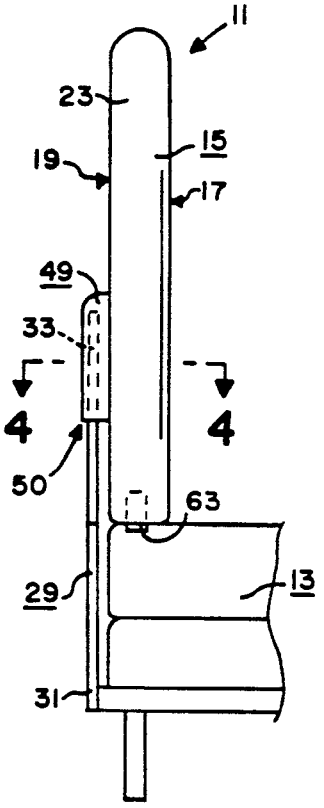
FIG. 3 is a side elevational view of FIG. 2 with a portion thereof broken away for clarity.
Figure 4:
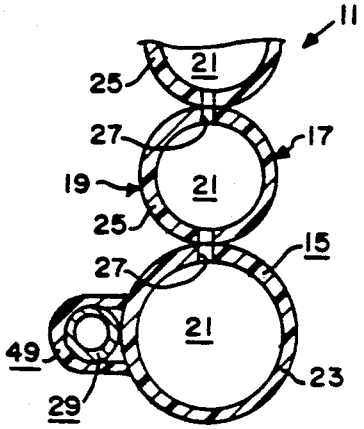
FIG. 4 is an enlarged sectional view substantially as taken on line 4—4 of FIG. 3 with portions thereof omitted for clarity.
Figure 5:
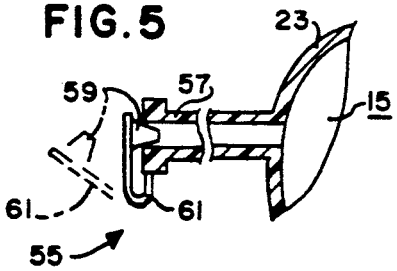
FIG. 5 is a sectional view of a first valve means of the headboard of the present invention with portions thereof broken away for clarity.
Figure 6:
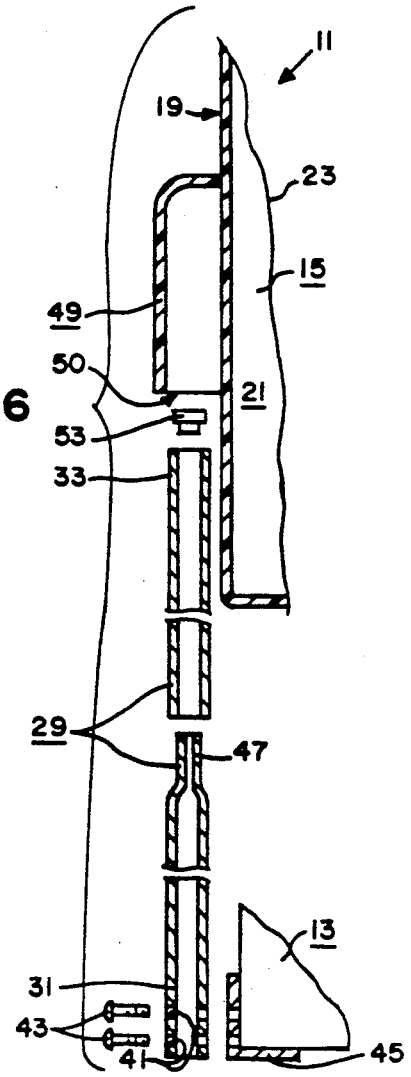
FIG. 6 is an exploded sectional view of portions of the preferred embodiment of the headboard of the present invention and portions of a typical bed frame.

The preferred embodiment of the headboard of the present invention is shown in FIGS. 1–6 and identified by the numeral 11. The headboard 11 is used in the typical manner to provide a decorative structure extending across the head of a bed 13 as clearly shown in FIG. 1. In addition, because of certain unique features of the headboard 11, it also provides a comfortable structure for being leaned against by one or more occupants of the bed 13, and can be easily and quickly replaced by another headboard of the same general construction but having a different color and/or design.

The headboard 11 includes an inflatable body member 15 for being positioned adjacent or above the head of the bed 13. The inflatable body member 15 preferably includes a face side 17, a back side 19, and a hollow interior 21. At least the face side 17 of the inflatable body member 15 is preferably of sufficient width so as to extend across the entire width of the bed 13. The specific shape and size of the inflatable body member 15 may vary depending on the size of the bed 13 (i.e., whether it is designed for use with a twin, full, queen or king size bed, etc.) and the style selected. Thus, for example, the inflatable body member 15 may have a generally "half circle" shape as shown in FIGS. 1 and 2 formed by a "half circle" outer tube 23 and a plurality of normally vertical tubes 25 extending downward from the outer tube 23 with the tubes 23, 25 joined to one another to form a single, integral unit and with ports or passageways 27 extending between the tubes 23, 25 (see FIG. 4) to allow air to pass between the tubes 23, 25 in a manner similar to a typical air mattress or the like as will now be apparent to those skilled in the art. The inflatable body member 15 may be constructed in various specific manners and out of various specific materials such as, for example, being molded, or cut and heat welded or glued, out of plastic or the like in any manner which will now be apparent to those skilled in the art to form a generally balloon-like structure.

The headboard 11 includes mounting means for mounting the inflatable body member 15 above the head of the bed 13. The mounting means may consist of coacting Velcro ® pieces or the like for removably securing the inflatable body member 15 directly to a bedroom wall or the like adjacent the head of the bed 13 as will now be apparent to those skilled in the art, or may consist of structure for supporting the inflatable body member 15 from the bedroom floor adjacent the head of the bed 13. Preferably, the mounting means includes a first mounting member 29 having a first end 31 for being fixedly attached to the head of the bed 13 and having a second end 33 for being mounted to the back side 19 of the inflatable body member 15, and includes a second mounting member 35 having a first end 37 for being fixedly attached to the head of the bed 13 and having a second end 39 for being mounted to the back side 19 of the inflatable body member 15.

The first ends 31 , 37 of the respective mounting members 29, 35 may be attached to the head of the bed 13 in various manners as will now be apparent to those skilled in the art. Preferably, each first end 31, 37 of each respective mounting member 29, 35 has a pair of spaced apart, transverse apertures 41 and screws 43 are provided for screwably attaching each mounting member 29, 35 to the frame 45 of the bed 13 (see, in general, FIG. 6) as will now be apparent to those skilled in the art.

Each mounting member 29, 35 may be constructed in various specific manners and out of various specific materials. For example, the mounting members 29, 35 may be constructed out of standard, rigid metal pipes or tubes having an outside diameter of 1 inch (2.54 centimeters). The length of the mounting members 29, 35 may vary depending on the shape and size of the inflatable body member 15, etc., as will now be apparent to those skilled in the art. However, each mounting member 29, 35 is preferably constructed in two parts or halves to allow the headboard 11 to be stored and shipped as an extremely compact unit. Thus, each mounting member 29, 35 is preferably divided into two parts of substantially equal length with one part (e.g., the normally lower part) having a crimped end 47 for being inserted into the opened end of the other part (e.g., the normally upper part) to thereby join the two parts together as will now be apparent to those skilled in the art (see, in general, FIG. 6).

The second ends 33, 39 of the respective mounting members 29, 35 may be mounted or attached to the back side 19 of the inflatable body member 15 in various specific manners as will now be apparent to those skilled in the art. The inflatable body member 15 preferably has a first pocket 49 on the back side 19 thereof having an entrance or mouth 50 on the normally bottom side thereof for receiving the second end 33 of the first mounting member 29 and a second pocket 51 on the back side 19 thereof having an entrance or mouth 52 on the normally bottom side thereof for receiving the second end 39 of the second mounting member 35 (see FIGS. 2, 3, 4 and 6). The pockets 49, 51 may be constructed in various specific manners and out of various specific materials such as, for example, by being molded, or cut out of plastic or the like, and heat welded or glued to the back side 19 of the inflatable body member 15 to form "pockets" for substantially tightly receiving the second ends 33, 39 of the respective mounting members 29, 35. Thus, the pockets 49, 51 may be constructed to have an inside diameter of 1.25 inches (3.175 centimeters) to snugly receive the second ends 31, 39 of the respective mounting members 29, 35 while allowing the inflatable body member 15 to be easily removed from and inserted on the mounting members 29, 35.

A cap 53 is preferably provided to close the upper end of each mounting member 29, 35 and to protect the respective pockets 49, 51. Each cap 53 may be constructed in various specific manners and out of various specific materials as will now be apparent to those skilled in the art.

The headboard 11 preferably includes a first valve means 55 for allowing air to be easily forced into the inflatable body member 15. The first valve means 55 may include a hollow stem 57 for communicating with the hollow interior 21 of the inflatable body member 15 for allowing a person to manually blow air into the hollow interior 21 of the inflatable body member 15 by holding the distal end of the stem 57 in his or her mouth and then blowing thereinto. The first valve means 55 may also include plug means 59 for plugging the hollow stem 57 to prevent air from escaping from the hollow interior 21 of the inflatable body member 15 through the hollow stem 57. A flexible strap 61 is preferably provided for securing the plug means 59 to the stem 57 to prevent loss of the plug means 59. The stem 57 is preferably flexible. The first valve means 55 may be constructed in various specific manners and out of various specific materials such as, for example, by being molded or otherwise formed out of plastic, and heat welded or glued to the inflatable body member 15 in any manner now apparent to those skilled in the art. The specific construction and operation of the first valve means 55 is preferably identical to that used on many blow-up beach balls, air mattresses, and the like as will now be apparent to those skilled in the art.

Figure 7:
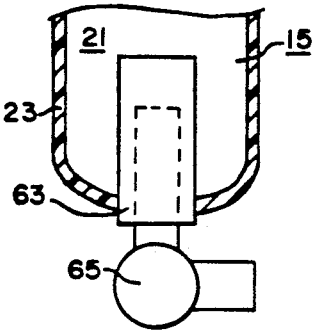
FIG. 7 is a sectional view of a second valve means of the headboard of the present invention with portions thereof broken away for clarity and with a typical hot air blower shown in combination therewith.

The headboard 11 preferably includes a second valve means 63 for allowing a hot air blower such as a typical portable hair dryer 65 or the like to be used to blow air into the hollow interior 21 of the inflatable body member 15 by merely inserting the nozzle of the portable hair dryer 65 or the like into the valve means 63 as shown in FIG. 7, and then activating the portable hair dryer 63. Such valve means 63 are well known to those skilled in the art and are used on many blow-up air mattresses and the like.

To use the headboard 11, the inflatable body member 15 is inflated using the first and/or second valve means 55, 63. Next, the mounting means is used to mount the inflatable body member 15 above the head of the bed 13 using the mounting means. More specifically, if the first and second mounting members 29, 35 are used, the first ends 31, 37 thereof are fixedly attached to the frame 45 of the bed 13 using the screws 43 or the like. The inflatable body member 15 can then be attached to the mounting members 29, 35 by merely inserting the pockets 49, 51 over the second ends 33, 39 of the respective mounting members 29, 35 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A headboard for the head of a bed, said headboard comprising:

a) an inflatable body member for being positioned adjacent the head of the bed, said inflatable body member including a face side and a back side, said face side having a width sufficient to extend across substantially the entire width of said bed; and b) mounting means for mounting said inflatable body member adjacent the head of the bed, said mounting means including at least one mounting member having a first end for being fixedly attached to the head of the bed and having a second end for being mounted to said back side of said inflatable body member.

2. The headboard of claim 1 in which is included valve means for allowing air to be forced into said inflatable body member.

3. The headboard of claim 2 in which said valve means includes adaptor means for allowing a hot air blower to be used to blow air into said hollow interior of said inflatable body member.

4. The headboard of claim 1 in which said inflatable body member has a hollow interior, and in which said valve means includes a hollow stem communicating with said hollow interior of said inflatable body member for allowing air to be manually blown into said hollow interior of said inflatable body member; and in which said valve means includes plug means for plugging said hollow stem to prevent air from escaping from said hollow interior of said inflatable body member through said hollow stem.

5. The headboard of claim 4 in which said stem is flexible.

6. The headboard of claim 1 in which said mounting means includes a first mounting member having a first end for being fixedly attached to the head of the bed and having a second end for being mounted to said back side of said inflatable body member; said mounting means including a second mounting member having a first end for being fixedly attached to the head of the bed and having a second end for being mounted to said back side of said inflatable body member.

7. The headboard of claim 6 in which said inflatable body member has a first pocket on said back side thereof having a mouth on the bottom side thereof for receiving said second end of said first mounting member; and in which said inflatable body member has a second pocket on said back side thereof having a mouth on the bottom side thereof for receiving said second end of said second mounting member.

8. The headboard of claim 7 in which said inflatable body member is constructed out of plastic.

9. A headboard for the head of a bed, said headboard comprising:

a) a hollow, flexible, inflatable body member for being positioned above the head of the bed; said inflatable body member including a face side and a back side, said face side having a width sufficient to extend across the entire width of said bed;

b) valve means for allowing air to be forced into said inflatable body member; said valve means including a hollow stem communicating with the interior of said inflatable body member for allowing air to be manually blown into the interior of said inflatable body member, and including plug means for plugging said hollow stem to prevent air from escaping from the interior of said inflatable body member through said hollow stem; and c) mounting means for mounting said inflatable body member above the head of the bed, said mounting means including a first mounting member having a first end for being fixedly attached to the head of the bed and having a second end for being mounted to said back side of said inflatable body member; said mounting means including a second mounting member having a first end for being fixedly attached to the head of the bed and having a second end for being mounted to said back side of said inflatable body member.

10. The headboard of claim 9 in which said inflatable body member has a first pocket on said back side thereof for receiving said second end of said first mounting member; and in which said inflatable body member has a second pocket on said back side thereof for receiving said second end of said second mounting member.

11. A headboard for the head of a bed, said headboard comprising:

a) a hollow, flexible, inflatable body member for being positioned above the head of the bed; said inflatable body member including a face side and a back side, said face side having a width sufficient to extend across the entire width of said bed; said inflatable body member having a first pocket on said back side thereof and a second pocket on said back side thereof;

b) first valve means for allowing air to be forced into said inflatable body member; said first valve means including a hollow stem communicating with the interior of said inflatable body member for allowing air to be manually blown into the interior of said inflatable body member, and including plug means for plugging said hollow stem to prevent air from escaping from the interior of said inflatable body member through said hollow stem;

c) second valve means for allowing a hot air blower to be used to blow air into the interior of said inflatable body member; and d) mounting means for mounting said inflatable body member above the head of the bed, said mounting means including a first mounting member having a first end for being fixedly attached to the head of the bed and having a second end for extending into said first pocket of said inflatable body member to attach said inflatable body member to said mounting means; said mounting means including a second mounting member having a first end for being fixedly attached to the head of the bed and having a second end for being inserted into said second pocket of said inflatable body member to attach said inflatable body member to said mounting means.

* * * * *